US010886621B2

(12) United States Patent
Tanaka et al.

(10) Patent No.: US 10,886,621 B2
(45) Date of Patent: Jan. 5, 2021

(54) ANTENNA DEVICE

(71) Applicant: PANASONIC INTELLECTUAL PROPERTY MANAGEMENT CO., LTD., Osaka (JP)

(72) Inventors: Yuki Tanaka, Tokyo (JP); Ryosuke Hasaba, Kanagawa (JP); Yoshio Koyanagi, Kanagawa (JP); Kazuki Kanai, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/298,076

(22) Filed: Mar. 11, 2019

(65) Prior Publication Data

US 2019/0288399 A1 Sep. 19, 2019

(30) Foreign Application Priority Data

Mar. 14, 2018 (JP) ..... 2018-046925

(51) Int. Cl.
*H01Q 13/16* (2006.01)
*H01Q 13/10* (2006.01)
(Continued)

(52) U.S. Cl.
CPC ..... *H01Q 13/16* (2013.01); *H01Q 1/243* (2013.01); *H01Q 1/48* (2013.01); *H01Q 13/10* (2013.01); *H01Q 13/106* (2013.01)

(58) Field of Classification Search
CPC ..... H01Q 13/16; H01Q 1/48; H01Q 5/371; H01Q 7/00; H01Q 1/36; H01Q 1/38;
(Continued)

(56) References Cited

U.S. PATENT DOCUMENTS 6,195,048 B1 * 2/2001 Chiba ..... H01Q 1/243 343/700 MS
6,456,249 B1 * 9/2002 Johnson ..... H01Q 1/243 343/700 MS (Continued)

FOREIGN PATENT DOCUMENTS

JP 4874035 B2 2/2012
KR 20080053081 A * 6/2008 ..... G06K 19/07749

OTHER PUBLICATIONS

The ARRL Antenna Book, published by the American Radio Relay League, chapter 2-24 to 2-25, 1988.*

*Primary Examiner* — Vibol Tan
(74) *Attorney, Agent, or Firm* — Pearne & Gordon LLP

(57) ABSTRACT

An antenna device includes a substrate having a ground conductor, an antenna conductor disposed approximately parallel with the ground conductor with an air layer or a dielectric layer, plural short-circuiting conductors that connect the antenna conductor to the ground conductor, and a feed conductor disposed in a vicinity of one of the plural short-circuiting conductors and that feeds the antenna conductor with power. When a wavelength of frequency used in the antenna device is represented by λ, an outer circumferential length of the slot is approximately 1λ to 2λ and a width of the slot is 0.005λ to 0.05λ, an interval between the plural short-circuiting conductors is shorter than or equal to λ/2, and a distance between the antenna conductor and the ground conductor is 0.005λ to 0.05λ.

7 Claims, 9 Drawing Sheets

(51) Int. Cl.
*H01Q 1/48* (2006.01)
*H01Q 1/24* (2006.01)

(58) Field of Classification Search
CPC ..... H01Q 11/14; H01Q 13/10; H01Q 13/106; H01Q 13/18; H01Q 13/206; H01Q 9/04; H01Q 9/0407; H01Q 9/0421; H01Q 13/085
See application file for complete search history.

(56) References Cited

U.S. PATENT DOCUMENTS 6,466,170 B2 * 10/2002 Zhou ..... H01Q 1/243 343/700 MS
6,831,607 B2 * 12/2004 Hebron ..... H01Q 1/243 343/700 MS
7,038,631 B2 * 5/2006 Jecko ..... H01Q 9/0421 343/702
8,253,640 B2 * 8/2012 Kitayoshi ..... H01Q 13/18 343/700 MS
8,378,910 B2 * 2/2013 Wolf ..... H01Q 3/24 343/768
8,933,842 B2 * 1/2015 Ayatollahi ..... H01Q 1/243 343/700 MS
9,105,975 B2 * 8/2015 Satou ..... H01Q 1/36
9,793,607 B2 * 10/2017 McGough ..... H01Q 5/357
9,843,100 B2 * 12/2017 Lee ..... H01Q 1/243
10,218,052 B2 * 2/2019 Pascolini ..... H01Q 9/0442
10,276,916 B2 * 4/2019 Hasaba ..... H01Q 9/0407
10,418,709 B1 * 9/2019 Furlan ..... H01Q 9/42
10,505,260 B2 * 12/2019 Inoue ..... H01Q 1/243
2004/0053635 A1 * 3/2004 Haapala ..... H01Q 5/371 455/522
2005/0057401 A1 * 3/2005 Yuanzhu ..... H01Q 9/0421 343/700 MS
2009/0273529 A1 * 11/2009 Liu ..... H01Q 9/0421 343/725
2010/0188306 A1 7/2010 Kitayoshi et al.
2016/0380340 A1 * 12/2016 Inoue ..... H01Q 21/08 343/702

* cited by examiner

DIRECTION IN YZ PLANE

DIRECTION IN XZ PLANE

ANTENNA ITSELF

STATE THAT HUMAN BODY
IS IN PROXIMITY
(INTERVAL: 5 mm)

FIG.9

| | ANTENNA ITSELF | STATE THAT HUMAN BODY IS IN PROXIMITY | DEGRADATION |
|---|---|---|---|
| GAIN | 2.45dBi | 1.15dBi | -1.3dB |
| EFFICIENCY | -1.3dB | -4.3dB | -3dB |

ANTENNA DEVICE

CROSS REFERENCE TO RELATED APPLICATIONS

This application is based on Japanese Patent Application (No. 2018-046925) filed on Mar. 14, 2018, the contents of which are incorporated herein by reference.

BACKGROUND OF THE INVENTION

1. Field of the Invention

The present disclosure relates to an antenna device that is suitable for use in small communication devices.

2. Description of the Related Art

In small communication terminals such as sensor terminals constituting a wireless sensor network, the antenna used in each of them needs to be miniaturized as the terminal is reduced in size or thickness. Where RFID (Radio Frequency Identification) is employed as a communication system, communication terminals function as RFID tags and, for example, communicate with and receive power from a reader/writer. To realize a thin, low-height small communication terminal such as an RFID tag, it is a common practice to use, as its antenna, a patch antenna, a slot antenna with a cavity (hereinafter referred to as a "cavity slot antenna" where appropriate), or the like.

For example, JP-B-4874035 discloses a thin slot antenna with a cavity for wireless communication in which a bag-shaped conductor having a cavity is formed by a conductive foil or the like. This configuration makes it possible to realize an inexpensive, thin cavity slot antenna.

The thin slot antenna with a cavity disclosed in JP-B-4874035 is configured so as to have a straight slot. The slot is as long as about one wavelength and this restricts the degree of reduction of its length in the slot longitudinal direction. The bag-shaped conductor is used to produce a cavity and the conductor needs to form a bag-shaped structure without forming a gap. As a result, it is difficult to produce an antenna device that is miniaturized further. Furthermore, since the antenna is fed within the slot and balanced feed is done, in the case where, for example, a microstrip line is used for coupling with a radio-frequency circuit, a problem arises that high-efficiency matching cannot be attained and it is difficult to improve the antenna performance.

SUMMARY OF THE INVENTION

The concept of the present disclosure has been conceived in view of the above circumstances in the art, and an object of the present disclosure is therefore to realize a cavity slot antenna that can be applied to small communication terminals such as RFID tags and to provide an antenna device that is miniaturized and enhanced in performance.

The present disclosure provides an antenna device including a substrate having a ground conductor, a flat-plate-shaped antenna conductor disposed approximately parallel with the ground conductor with an air layer or a dielectric layer interposed between them and has a closed polygon-shaped slot that is bent at least one position; plural short-circuiting conductors that connect the antenna conductor to the ground conductor; and a feed conductor disposed in a vicinity of one of the plural short-circuiting conductors and that feeds the antenna conductor with power, wherein when a wavelength of frequency used in the antenna device is represented by λ, an outer circumferential length of the slot is approximately 1λ to 2λ and a width of the slot is 0.005λ to 0.05λ, an interval between the plural short-circuiting conductors is shorter than or equal to λ/2, and a distance between the antenna conductor and the ground conductor is 0.005λ to 0.05λ.

The disclosure also provides an antenna device that is based on the above antenna device and in which the antenna conductor is configured by a plate-like member having an approximately rectangular external shape and has extension portions which extend from a shorter side or a longer side of the plate-like member and are bent approximately perpendicularly to a plane having the slot to form bent portions; and the short-circuiting conductors are formed by the bent portions of the antenna conductor.

This disclosure makes it possible to realize a cavity slot antenna that can be applied to small communication terminals such as RFID tags and to provide an antenna device that is miniaturized and enhanced in performance.

BRIEF DESCRIPTION OF THE DRAWINGS

FIG. 1A is a perspective view of the entire antenna device and FIG. 1B is an exploded perspective view of an antenna conductor and a substrate.

FIG. 2A is a plan view of the antenna conductor, FIG. 2B is a side view of the antenna device as seen from the side of the shorter side and FIG. 2C is a side view of the antenna device as seen from the side of the longer side.

FIG. 3A shows a characteristic in the YZ plane and FIG. 3B shows a characteristic in the XZ plane.

FIG. 4A is a perspective view of the entire antenna device and FIG. 4B is an exploded perspective view of an antenna conductor and a substrate.

FIG. 5A is a plan view of the antenna conductor and FIG. 5B is a plan view of a ground conductor.

FIG. 6A is a plan view of the antenna conductor and FIG. 6B is a side view of the antenna device as seen from the side of the shorter side and FIG. 6C is a side view of the antenna device as seen from the side of the longer side.

FIGS. 7A and 7B show a characteristic in the YZ plane and a characteristic in the XZ plane, respectively.

FIG. 8A shows a characteristic of the antenna device itself and FIG. 8B shows a characteristic of the antenna device in a state that a human body is located close to it.

FIG. 9 is a table showing how the gain and the efficiency vary between the two states of FIGS. 8A and 8B.

DETAILED DESCRIPTION OF THE EXEMPLARY EMBODIMENTS

An antenna device according to each specific embodiment of the present disclosure will be hereinafter described in detail with reference to the drawings when necessary. However, unnecessarily detailed descriptions may be omitted. For example, detailed descriptions of well-known items and duplicated descriptions of constituent elements having substantially the same ones already described may be omitted. This is to prevent the following description from becoming unnecessarily redundant and thereby facilitate understanding of those skilled in the art.

The following description and the accompanying drawings are provided to allow those skilled in the art to understand the disclosure sufficiently and are not intended to restrict the subject matter set forth in the claims.

Embodiment 1

Figure 1A:
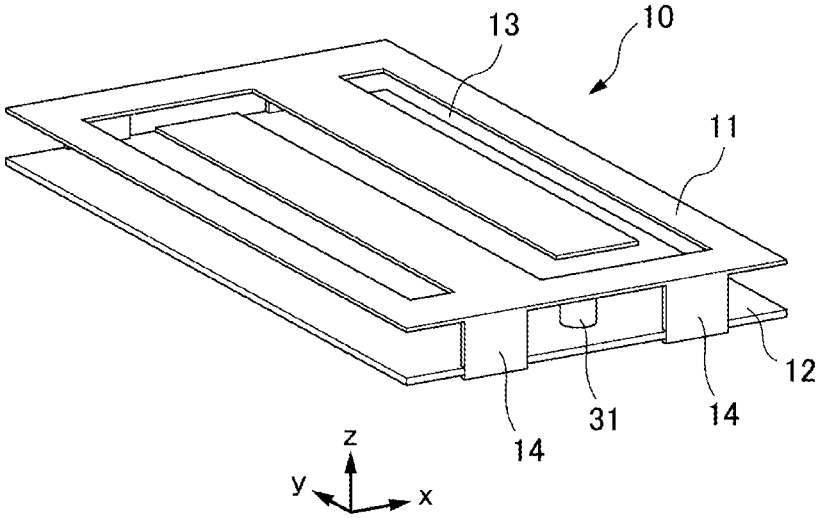
FIGS. 1A and 1B show a general configuration of an antenna device according to a first embodiment; more specifically.
Figure 1B:
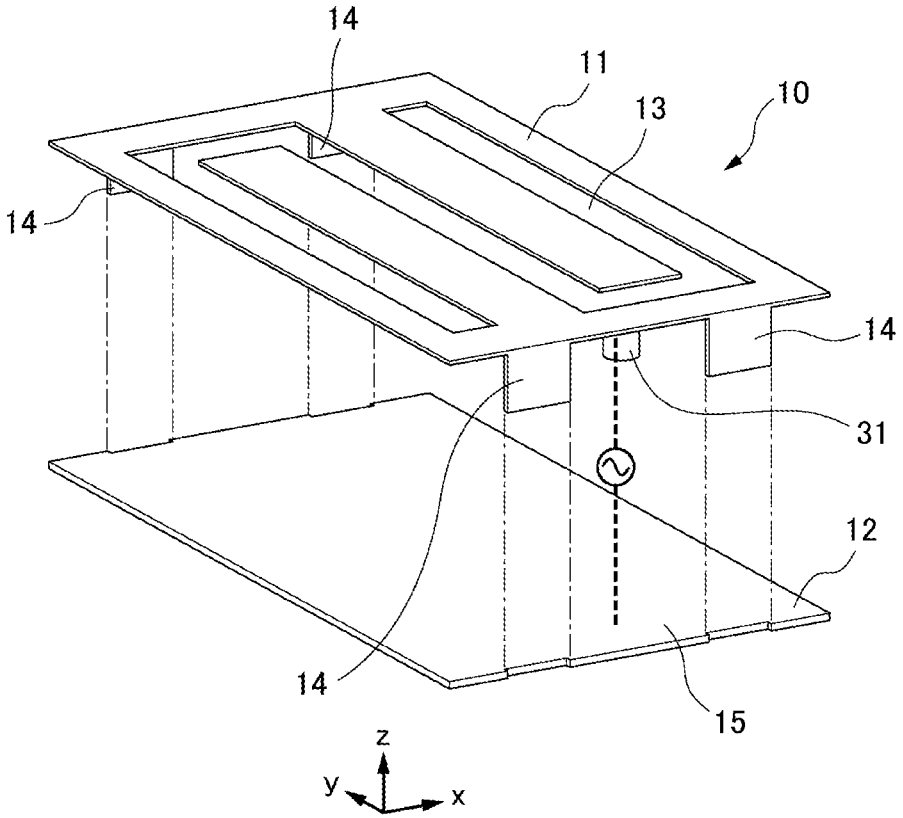

FIGS. 1A and 1B show a general configuration of an antenna device 10 according to a first embodiment; more specifically, FIG. 1A is a perspective view of the entire antenna device 10 and FIG. 1B is an exploded perspective view of an antenna conductor 11 and a substrate 12. The first embodiment is directed to an example basic configuration of a cavity slot antenna according to the disclosure.

The antenna device 10 according to the first embodiment includes the antenna conductor 11 which is shaped like a flat plate and the substrate 12. The antenna conductor 11 has an approximately rectangular external shape and has a closed polygon-shaped slot 13 which is bent at plural positions so as to assume a meandering shape. The antenna conductor 11 functions as a conductor plate and a radiation plate. The antenna conductor 11 is formed by a metal plate that is about 0.1 to 1 mm in thickness and is made of, for example, nickel silver (an alloy of copper, zinc, and nickel).

As shown in FIGS. 1A and 1B, the X-axis direction and the Y-axis direction are defined as the shorter-side direction and the longer-side direction of the antenna conductor 11, respectively, and the Z-axis direction is defined as the direction that is perpendicular to the antenna conductor 11. These definitions also apply to the following drawings. In this specification, the wavelength of the frequency used in the antenna device (i.e., the wavelength of a center frequency of a frequency range used) will be represented by $\lambda$.

The antenna conductor 11 and the substrate 12 are arranged approximately parallel with each other so as to be spaced from each other by a prescribed interval and are connected to each other and thereby short-circuited by two or more short-circuiting conductors 14 (short-circuiting portions). The antenna conductor 11, which is formed by a plate-like member, has a total of four extension portions (two on each shorter side of the antenna conductor 11) that are bent approximately perpendicularly to the plane, having the slot 13, of the antenna conductor 11 to become bent portions. The bent portions of the antenna conductor 11 constitute the respective short-circuiting conductors 14. The bent portions of the antenna conductor 11 function as support portions that are arranged approximately parallel with each other so as to be spaced from each other by the prescribed interval and support the antenna conductor 11 and the substrate 12. The number of short-circuiting conductors 14 is not limited to four (see FIGS. 1A and 1B) and may be two, three, or five or more. Alternatively, the short-circuiting conductors 14 may be bent portions that are formed by bending extension portions of longer side portions of the antenna conductor 11 approximately perpendicularly. As a further alternative, the short-circuiting conductors 14 may be conductor members that are separate from the antenna conductor 11.

The substrate 12 is, for example, a printed circuit board and has a ground conductor 15 having a ground pattern (e.g., "painted-out" pattern). The ground conductor 15 functions as a bottom plate. The ground conductor 15 is, for example, a copper foil having a wiring pattern of a printed circuit board. Alternatively, the ground conductor 15 may be a metal plate made of nickel silver, for example. End portions of the respective short-circuiting conductors 14 are connected to the ground conductor 15 of the substrate 12 by soldering, for example.

A feed conductor 31 that is a feed pin, for example, and constitutes a feed portion is provided in the vicinity of one shorter side of the antenna conductor 11 at the center in the X-axis direction and one end of the feed conductor 31 is connected to the antenna conductor 11, whereby the antenna device 10 is fed with power. The feed conductor 31 is disposed in the vicinity of the two short-circuiting conductors 14 located on the one shorter side of the antenna conductor 11 so as to be approximately parallel with the short-circuiting conductors 14. The other end of the feed conductor 31 is connected to the substrate 12 so as to be insulated from the ground conductor 15.

The antenna device 10 has, in the antenna conductor 11, the closed polygon-shaped slot 13 which is bent at at least one position. The antenna conductor 11 is short-circuited with the ground conductor 15 of the substrate 12 which is approximately parallel with the antenna conductor 11, by the plural short-circuiting conductors 14, whereby a cavity is formed between the antenna conductor 11 and the ground conductor 15. Having such a slot 13, the antenna device 10 functions as a slot antenna with a cavity. An air layer may be formed between the antenna conductor 11 and the ground conductor 15. Alternatively, a dielectric layer may be provided between the antenna conductor 11 and the ground conductor 15 by, for example, filling the space between them with a dielectric. The insertion of the dielectric layer means formation of a support structure in which the antenna conductor 11 and the substrate 12 are supported by the dielectric layer so as to have a prescribed interval and the cavity is thereby held. Spaces are formed between the plural short-circuiting conductors 14 and between the antenna conductor 11 and the substrate 12. In this manner, a cavity slot antenna is configured having such directivity that the maximum radiation direction is the Z-axis direction which is perpendicular to the antenna conductor 11 and the ground conductor 15.

Figure 2A:
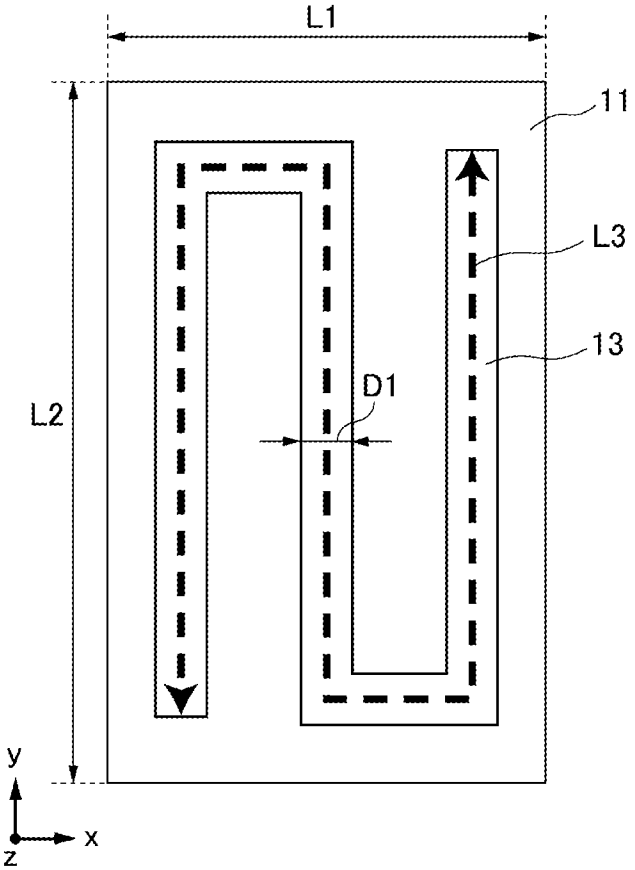
FIGS. 2A to 2C show the configuration of the antenna device according to the first embodiment; more specifically.
Figure 2B:
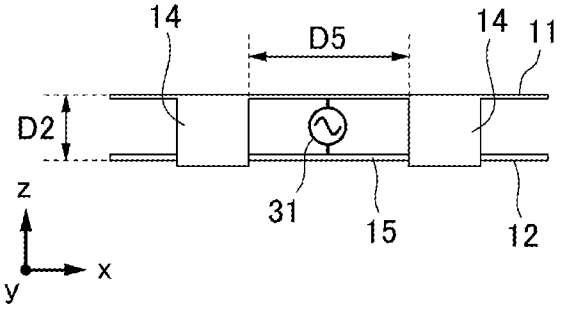
Figure 2C:
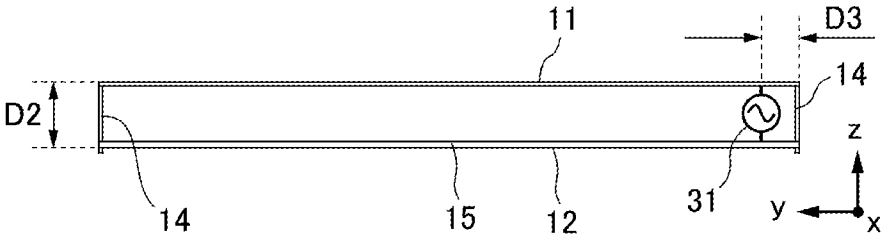

FIGS. 2A to 2C show the configuration of the antenna device 10 according to the first embodiment; more specifically, FIG. 2A is a plan view of the antenna conductor 11 and FIGS. 2B and 2C are side views of the antenna device 10 as seen from the side of the short side and the longer side, respectively. For example, the shorter-side length L1 and the longer-side length L2 of the antenna conductor 11 are set at $0.15\lambda$ (about $\lambda/6$) and $0.257\lambda$ (about $\lambda/4$), respectively. The shorter-side length L1 and the longer-side length L2 of the antenna conductor 11 may be in a range of $\lambda/8$ to $\lambda/2$. The external shape of the substrate 12 and the ground conductor 15 is made approximately the same in size as the antenna conductor 11.

The slot 13 has a meandering shape (shaped approximately like a character S whose bottom is located on the side of a longer side of the antenna conductor 11) obtained by connecting three slits extending in the longer-side direction of the antenna conductor 11 as if to draw a single-stroke figure. For another example, the slot 13 may be U-shaped. For example, the length L3 is set at 0.82λ and the width D1 of the slot 13 is set at 0.02λ. The total length of the edges (conductor-air boundaries) of the slot 13 is approximately set in a range of 1λ to 2λ. The length L3 of the slot 13 may be in a range of 0.5λ to 1.0λ and the width D1 of the slot 13 may be in a range of 0.005λ to 0.05λ.

For example, the distance D2 between the antenna conductor 11 and the ground conductor 15 of the substrate 12, that is, the thickness of the air layer or the dielectric layer, is set at 0.022λ. The distance D2 may be approximately equal to the width D1 of the slot 13 and may be in a range of 0.005λ to 0.05λ. For example, the distance D3 between the feed conductor 31 and the nearby edge of the substrate 12 is set at 0.012λ. The distance D5 between each pair of short-circuiting conductors 14 is set at 0.05λ, for example, and the distance D5 between every pair of short-circuiting conductors 14 may be shorter than or equal to about λ/2, particularly about λ/4.

Figure 3A:
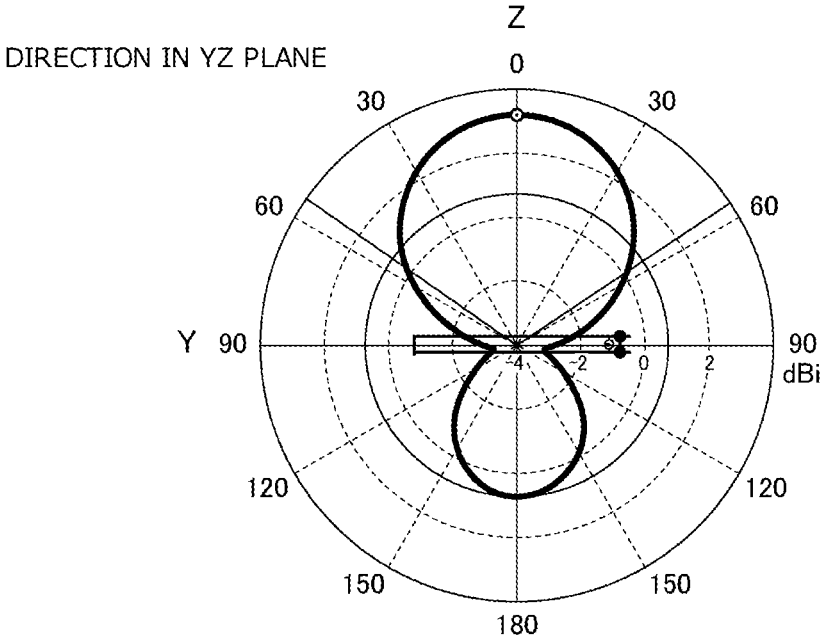
FIGS. 3A and 3B are graphs showing an antenna characteristic of the antenna device according to the first embodiment; more specifically.
Figure 3B:
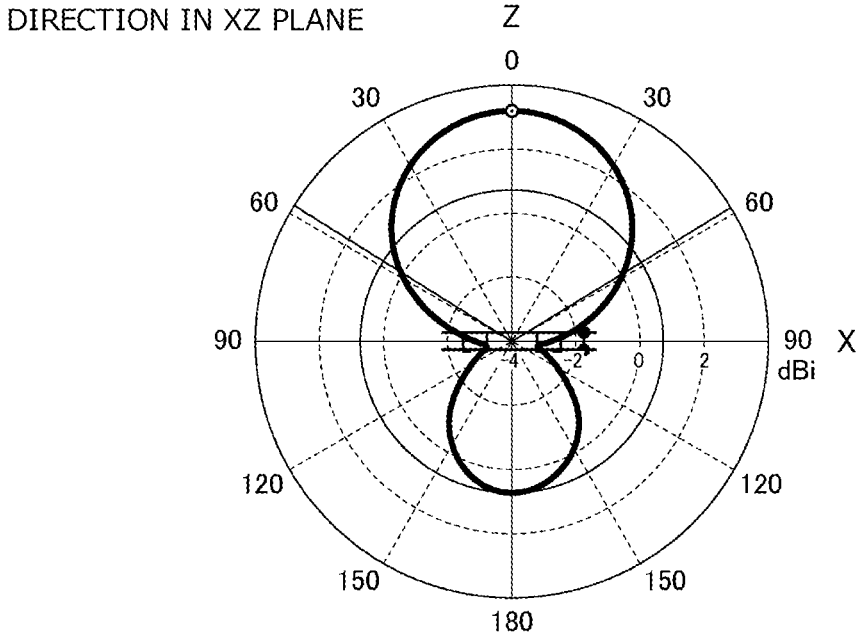

FIGS. 3A and 3B are graphs showing an antenna characteristic of the antenna device 10 according to the first embodiment; more specifically, FIGS. 3A and 3B show a characteristic in the YZ plane and a characteristic in the XZ plane, respectively. FIGS. 3A and 3B each show simulation results of a radiation characteristic and a reception characteristic of the antenna device 10 obtained at a frequency f=0.9 GHz. FIG. 3A shows a characteristic in the θ direction in the YZ plane, and θ=90° on the left side corresponds to the positive Y-axis direction and θ=0° at the top corresponds to the positive Z-axis direction. FIG. 3B shows a characteristic in the ϕ direction in the XZ plane, and ϕ=90° on the right side corresponds to the positive X-axis direction and ϕ=0° at the top corresponds to the positive Z-axis direction.

As shown in FIGS. 3A and 3B, the antenna device 10 according to this embodiment is an antenna having such directivity that the maximum radiation direction is the Z-axis direction which is perpendicular to the antenna conductor 11. Good gain and directivity characteristics have been obtained in which the gain of the main lobe extending in the Z-axis direction is 3.14 dBi, the −3 dB half-width is 111.4 deg. in the YZ plane and 116.0 deg. in the XZ plane, and the side lobe level is −2.4 dB.

Embodiment 2

Figure 4A:
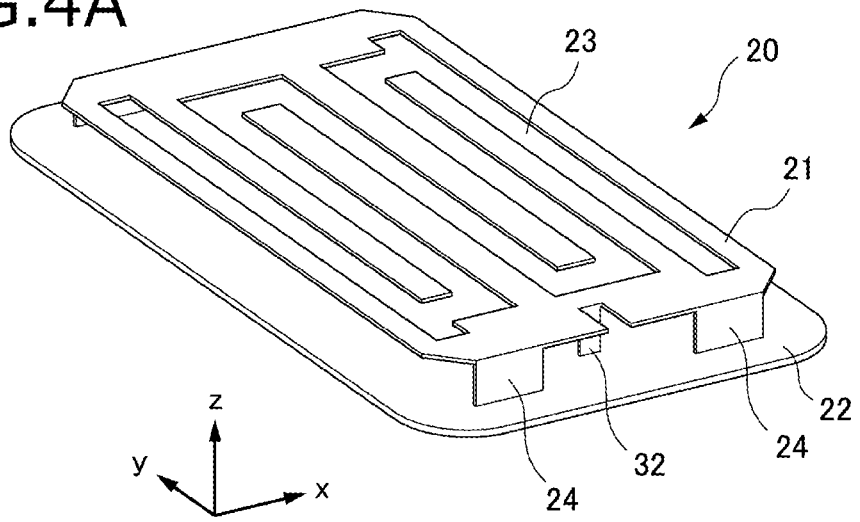
FIGS. 4A and 4B show a general configuration of an antenna device according to a second embodiment; more specifically.
Figure 4B:
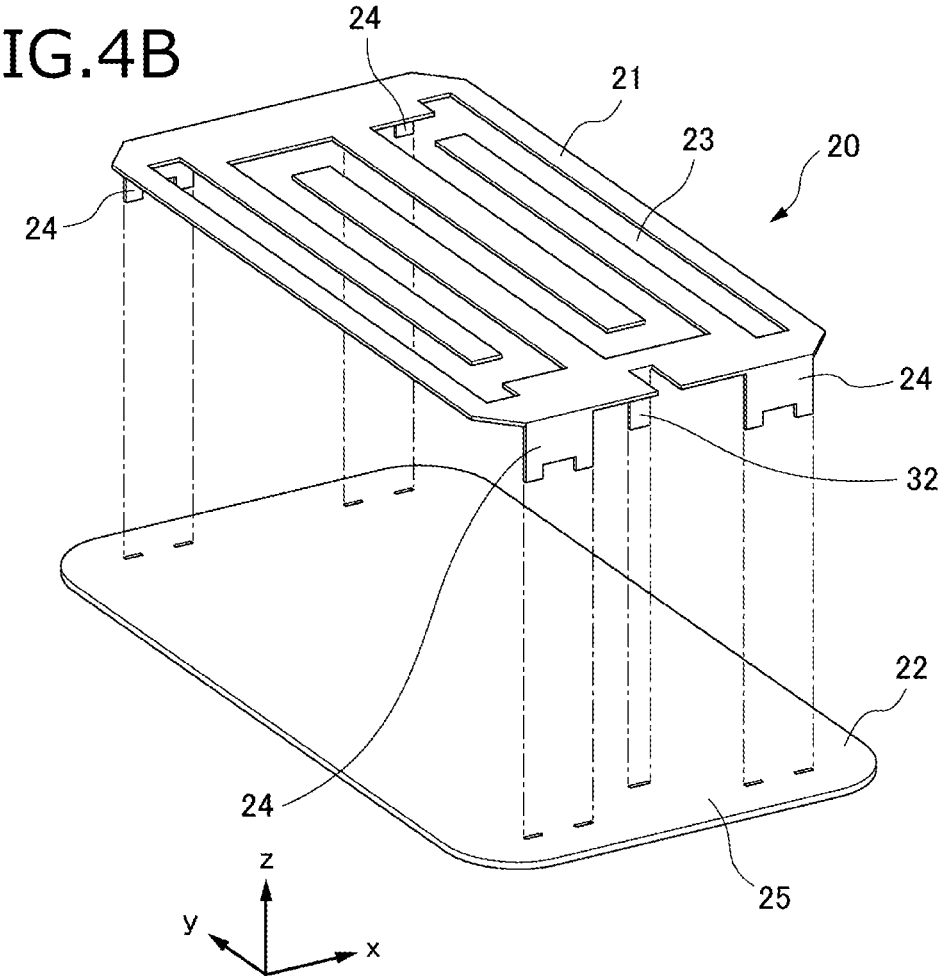

FIGS. 4A and 4B show a general configuration of an antenna device 20 according to a second embodiment; more specifically, FIG. 4A is a perspective view of the entire antenna device 20 and FIG. 4B is an exploded perspective view of an antenna conductor 21 and a substrate 22. The second embodiment is directed to an example configuration in which modifications are made of the shapes of the antenna conductor 11 and the substrate 12 employed in the first embodiment.

The antenna device 20 according to the second embodiment is equipped with an antenna conductor 21 which is shaped like a flat plate and a substrate 22. The antenna conductor 21 has an approximately rectangular external shape whose four corners are cut away and has a closed polygon-shaped slot 23 which is bent at plural positions so as to assume a meandering shape. The antenna conductor 21 is formed by a metal plate that is about 0.1 to 1 mm in thickness and is made of, for example, nickel silver. As shown in FIGS. 4A and 4B, the X-axis direction and the Y-axis direction are defined as the shorter-side direction and the longer-side direction of the antenna conductor 21, respectively, and the Z-axis direction is defined as the direction that is perpendicular to the antenna conductor 21. These definitions also apply to the following drawings.

The antenna conductor 21 and the substrate 22 are connected to each other and thereby short-circuited by two or more short-circuiting conductors 24 (short-circuiting portions) which are arranged approximately parallel with each other so as to be spaced from each other by a prescribed interval. The antenna conductor 21, which is formed by a plate-like member, has a total of four extension portions (two on each shorter side of the antenna conductor 21) that are bent approximately perpendicularly to the plane, having the slot 23, of the antenna conductor 21 to become bent portions. The bent portions of the antenna conductor 21 constitute the respective short-circuiting conductors 24. The bent portions of the antenna conductor 21 function as support portions that are arranged approximately parallel with each other so as to be spaced from each other by the prescribed interval and support the antenna conductor 21 and the substrate 22. The number of short-circuiting conductors 24 is not limited to four (see FIGS. 4A and 4B) and may be two, three, or five or more. Alternatively, the short-circuiting conductors 24 may be bent portions that are formed by bending extension portions of longer side portions of the antenna conductor 21 approximately perpendicularly. As a further alternative, the short-circuiting conductors 24 may be conductor members that are separate from the antenna conductor 21.

Figure 5B:
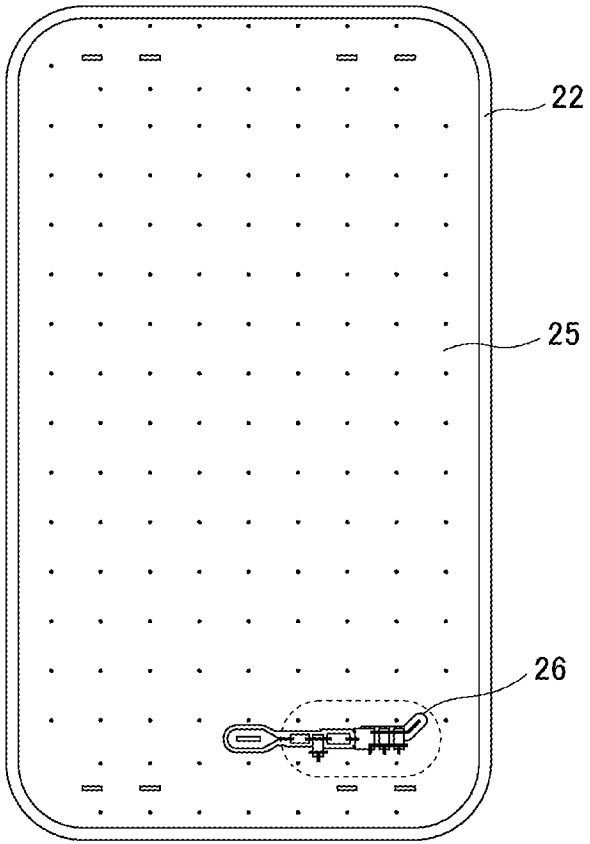
FIGS. 5A and 5B show the configuration of an antenna device according to a second embodiment; more specifically.
Figure 5A:
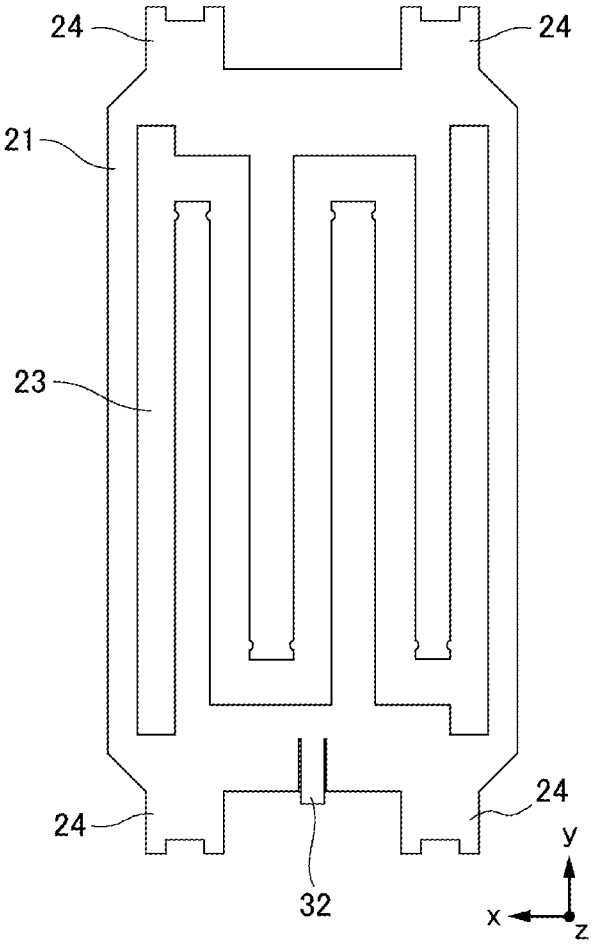

FIGS. 5A and 5B show the configuration of the antenna device 20 according to the second embodiment; more specifically, FIGS. 5A and 5B are plan views of the antenna conductor 21 and the substrate 22, respectively, as viewed from the bottom surface side, that is, from the side of the outside surface of the substrate 22, in FIGS. 4A and 4B.

The substrate 22 is, for example, a printed circuit board and has a ground conductor 25 having a ground pattern (e.g., "painted-out" pattern). The ground conductor 25 functions as a bottom plate. The ground conductor 25 is, for example, a copper foil having a wiring pattern of a printed circuit board. Alternatively, the ground conductor 25 may be a metal plate made of nickel silver, for example. End portions of the respective short-circuiting conductors 24 are connected to the ground conductor 25 of the substrate 22 by soldering, for example.

A feed conductor 32 that constitutes a feed portion is provided in the vicinity of one shorter side of the antenna conductor 21 at the center in the X-axis direction, whereby the antenna device 10 is fed with power. The feed conductor 32 is a bent portion that is formed by bending a portion partially cut-separated from a shorter-side portion of the antenna conductor 21 approximately perpendicularly to the plane, having the slot 23, of the antenna conductor 21. Thus, the feed conductor 32 is unitized with the antenna conductor 21. The feed conductor 32 is disposed in the vicinity of the two short-circuiting conductors 24 located on the one shorter side of the antenna conductor 21 so as to be approximately parallel with the short-circuiting conductors 24. The other end of the feed conductor 32 is connected to the substrate 22 so as to be insulated from the ground conductor 25.

Circuit components 26 such as a capacitor and an inductor that constitute a feed circuit are mounted on one surface of the substrate 22. The circuit components 26 may be mounted on either surface of the substrate 22, that is, the outer surface opposite to the antenna conductor 21 or the surface facing the space located on the side of the antenna conductor 21.

The antenna device 20 has, in the antenna conductor 21, the closed polygon-shaped slot 23 which is bent at at least one position. The antenna conductor 21 is short-circuited with the ground conductor 25 of the substrate 22 which is approximately parallel with the antenna conductor 21, by the plural short-circuiting conductors 24, whereby a cavity is formed between the antenna conductor 21 and the ground conductor 25. Having such a slot 23, the antenna device 20 functions as a slot antenna with a cavity. An air layer may be formed between the antenna conductor 21 and the ground conductor 25. Alternatively, a dielectric layer may be provided between the antenna conductor 21 and the ground conductor 25 by, for example, filling the space between them with a dielectric. The insertion of the dielectric layer means formation of a support structure in which the antenna conductor 21 and the substrate 22 are supported by the dielectric layer so as to have a prescribed interval and the cavity is thereby held. Spaces are formed between the plural short-circuiting conductors 24 and between the antenna conductor 21 and the substrate 22. In this manner, a cavity slot antenna is configured having such directivity that the maximum radiation direction is the Z-axis direction which is perpendicular to the antenna conductor 21.

Figure 6A:
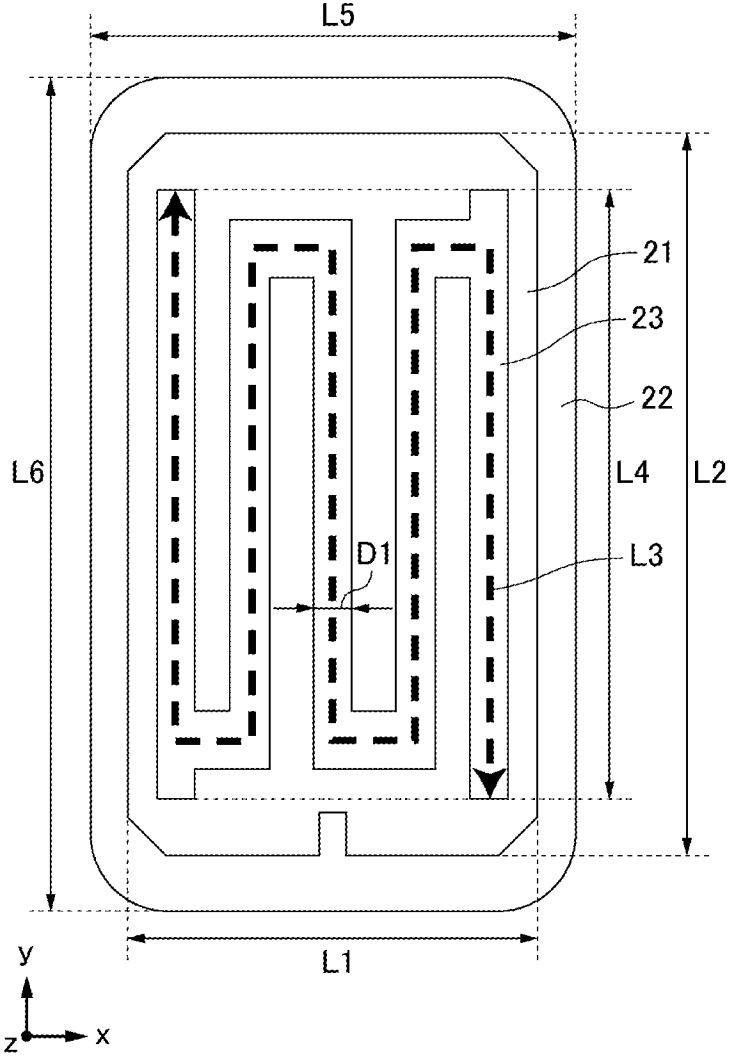
FIGS. 6A to 6C show the configuration of the antenna device according to the second embodiment; more specifically.
Figure 6B:
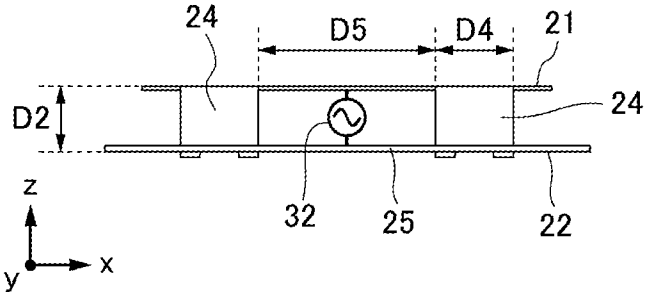
Figure 6C:
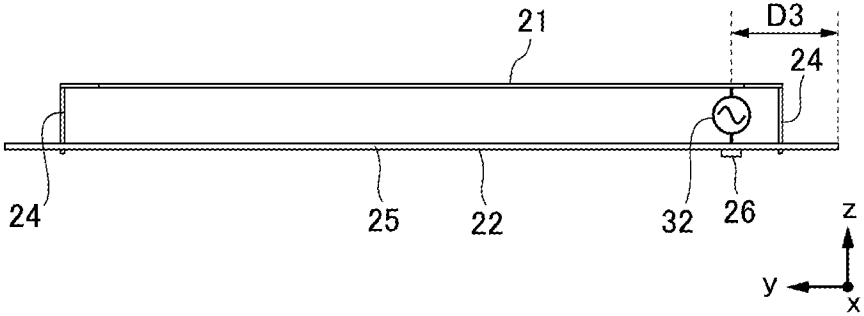

FIGS. 6A to 6C also show the configuration of the antenna device 20 according to the second embodiment; more specifically, FIG. 6A is a plan view of the antenna conductor 21 and FIGS. 6B and 6C are side views of the antenna device 20 as seen from the side of the shorter side and the longer side direction. For example, the shorter-side length L1 and the longer-side length L2 of the antenna conductor 21 are set at 0.129λ (about λ/8) and 0.227λ (about λ/4), respectively. The shorter-side length L1 and the longer-side length L2 of the antenna conductor 21 may be in a range of λ/8 to λ/2. For example, the shorter-side length L5 and the longer-side length L6 of the substrate 22 and the ground conductor 25 are set at 0.15λ (about λ/6) and 0.257λ (about λ/4), respectively. The shorter-side length L5 and the longer-side length L6 of the substrate 22 and the ground conductor 25 may be in a range of λ/8 to λ/2.

The slot 23 has a meandering shape obtained by connecting five slits extending in the longer-side direction of the antenna conductor 21 as if to draw a single-stroke figure. The slot 23 may be shaped approximately like a character S or U. For example, the length L3 and the width D1 of the slot 23 are set at 0.85λ and 0.012λ, respectively. The total length of the edges (conductor-air boundaries) of the slot 23 is approximately set in a range of 1λ to 2λ. For example, the length L4 of the meandering slot 23 in the longer-side direction of the antenna conductor 21 is set at 0.19λ and may be shorter than or equal to λ/2, particularly λ/4. The length L3 and the width D1 of the slot 13 may be in a range of 0.5λ to 1.0λ, and in a range of 0.005λ to 0.05λ, respectively.

For example, the distance D2 between the antenna conductor 21 and the ground conductor 25 of the substrate 22, that is, the thickness of the air layer or the dielectric layer, is set at 0.019λ. The distance D2 may be approximately equal to the width D1 of the slot 23 and may be in a range of 0.005λ to 0.05λ. For example, the distance D3 between the feed conductor 32 and the nearby edge of the substrate 22 is set at 0.031λ. For example, the width D4 of each short-circuiting conductor 14 is set at 0.025λ. The distance D5 between each pair of short-circuiting conductors 14 is set at 0.05λ, for example, and the distance D5 between every pair of short-circuiting conductors 14 may be shorter than or equal to about λ/2, particularly about λ/4.

Figure 7A:
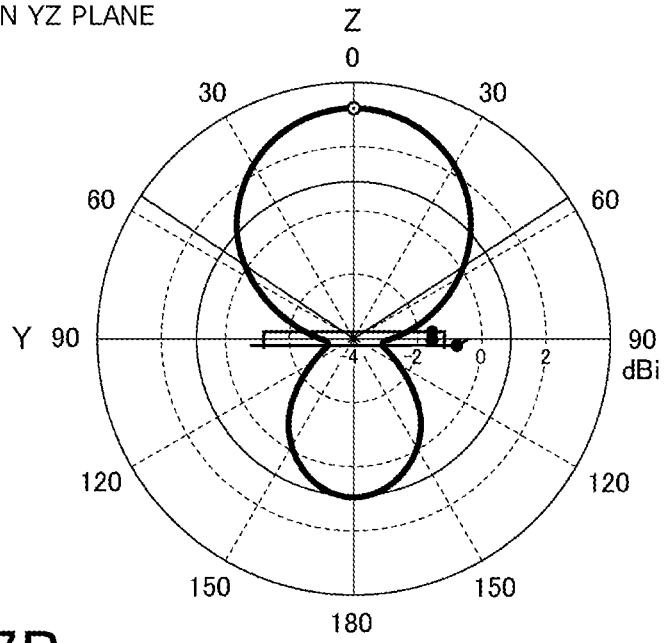
FIGS. 7A and 7B are graphs showing an antenna characteristic of the antenna device according to the second embodiment; more specifically.
Figure 7B:
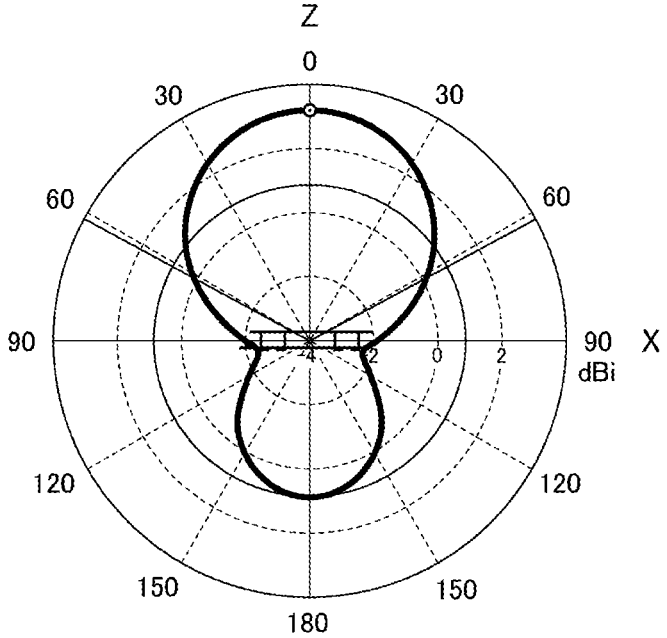

FIGS. 7A and 7B are graphs showing an antenna characteristic of the antenna device 20 according to the second embodiment; more specifically, FIGS. 7A and 7B show a characteristic in the YZ plane and a characteristic in the XZ plane, respectively. FIGS. 7A and 7B each show simulation results of a radiation characteristic and a reception characteristic of the antenna device 20 obtained at a frequency f=0.94 GHz. FIG. 7A shows a characteristic in the θ direction in the YZ plane, and θ=90° on the left side corresponds to the positive Y-axis direction and θ=0° at the top corresponds to the positive Z-axis direction. FIG. 7B shows a characteristic in the ϕ direction in the XZ plane, and ϕ=90° on the right side corresponds to the positive X-axis direction and ϕ=0° at the top corresponds to the positive Z-axis direction.

As shown in FIGS. 7A and 7B, the antenna device 20 according to this embodiment is an antenna having such directivity that the maximum radiation direction is the Z-axis direction which is perpendicular to the antenna conductor 21. Good gain and directivity characteristics have been obtained in which the gain of the main lobe extending in the Z-axis direction is 3.13 dBi, the −3 dB half-width is 112.4 deg. in the YZ plane and 122.9 deg. in the XZ plane, and the side lobe level is −2.2 dB.

Figure 8A:
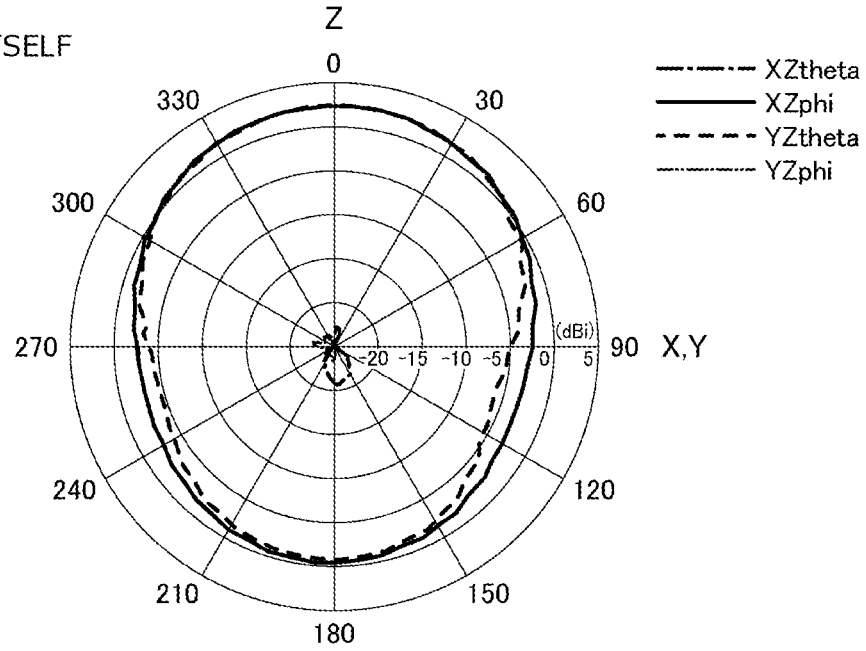
FIGS. 8A and 8B are graphs also showing antenna characteristics of the antenna device according to the second embodiment; more specifically.
Figure 8B:
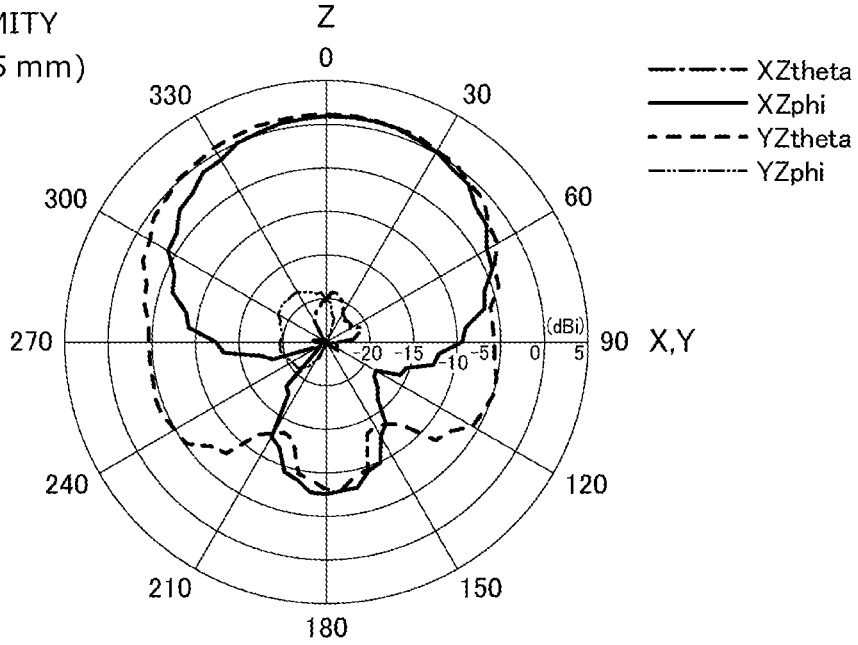

FIGS. 8A and 8B are graphs also showing antenna characteristics of the antenna device 20 according to the second embodiment; more specifically, FIG. 8A shows a characteristic of the antenna device 20 itself and FIG. 8B shows a characteristic of the antenna device 20 in a state that a human body is located close to it. FIGS. 8A and 8B show actual measurement results that were obtained in a state the antenna device 20 stood alone and a state that a human body phantom was located close to it to simulate a state that a human body is located close to it.

FIG. 8A shows a characteristic of the antenna device 20 according to the second embodiment in a state that it was located in a free space, and FIG. 8B shows a characteristic of the antenna device 20 in a state that a human body phantom was located close to it, more specifically, at a position that is distant from the substrate 22 of the antenna device 20 by 5 mm. In each of FIGS. 8A and 8B, a solid-like curve (XZphi) represents a characteristic in the ϕ direction in the XZ plane and a broken-line curve (YZtheta) represents a characteristic in the θ direction in the YZ plane, a chain-line curve (XZtheta) represents a characteristic in the θ direction in the XZ plane, and a two-dot chain line curve (YZphi) represents a characteristic in the ϕ direction in the YZ plane. θ or ϕ=90° on the right side corresponds to the positive X-axis or Y-axis direction and θ or ϕ=0° at the top corresponds to the Z-axis direction.

FIG. 9 is a table showing how the gain and the efficiency vary between the two states of FIGS. 8A and 8B. Whereas the gain in the Z direction was 2.45 dBi and the efficiency was −1.3 dB in the state that the antenna device 20 stood alone, the gain in the Z direction was 1.15 dBi and the efficiency was −4.3 dB in the state that the human body phantom was located close to the antenna device 20. In the antenna device 20 according to the embodiment, a gain of about 2 to 3 dBi was secured in the free space and a gain of about 1 dBi was secured even when the human body phantom was located close to the antenna device 20. The degradations of the gain and the efficiency due to the close existence of the human body phantom were as small as 1.3 dB and 3 dB, respectively. In the case of common dipole antennas, the performance degradations due to the close existence of a human body are about 10 dB. It can therefore be said that in the antenna device 20 according to the second embodiment the influence of a human body on the radiation in the Z-axis direction (the maximum radiation direction of its directivity) can be suppressed.

Each of the antenna devices 10 and 20 according to the embodiments is configured in such a manner that the flat-plate-shaped antenna conductor 11 or 21 and the substrate 12 or 22 having the ground conductor 15 or 25 are arranged approximately parallel with each other and connected to each other by the plural short-circuiting conductors 14 or 24. The antenna conductor 11 or 21 has a closed polygon-shaped slot 13 or 23, whereby the antenna open end is closed inside the antenna conductor 11 or 21. That is, the slot 13 or 23 has no open portion and forms a closed path. The distance between every pair of short-circuiting conductors 14 or 24 is shorter than or equal to $\lambda/2$, whereby the gap between each pair of short-circuiting conductors 14 or 24 does not function as a slot of the slot antenna. The outer circumferential length of the slot 13 or 23 is approximately equal to $1\lambda$ to $2\lambda$ and the width of the slot 13 or 23 is equal to $0.005\lambda$ to $0.05\lambda$. The distance between the antenna conductor 11 or 21 and the substrate 12 or 22 is equal to $0.005\lambda$ to $0.05\lambda$. This configuration makes it possible to realize a cavity slot antenna that is simple in structure and can be assembled easily.

The antenna conductor 11 or 21 may be formed with the closed polygon-shaped slot 13 or 23 that is bent so as to assume a meandering shape, for example. The antenna conductor 11 or 21 may be formed by a plate-like member having an approximately rectangular external shape and may be such that the lengths of its shorter sides and longer sides is equal to $\lambda/8$ to $\lambda/2$ and the length of the slot 13 or 23 in the longer-side direction of the antenna conductor 11 or 21 is shorter than or equal to $\lambda/2$. With these measures, the area of the antenna conductor 11 or 21 can be reduced and the antenna can be miniaturized.

The antenna device 10 or 20 may be configured in such a manner that a gap is formed between each pair of short-circuiting conductors 14 or 15 and the feed conductor 31 or 32 is provided in the vicinity of a pair of short-circuiting conductors 14 or 15 between the antenna conductor 11 or 21 and the substrate 12 or 22. With these measures, the antenna conductor 11 or 21 having the slot 13 or 23 can be fed with power by unbalanced feed. Since the antenna device 10 or 20 can be connected to a microstrip line or the like, a wireless transmission/reception unit as a whole including the antenna device 10 or 20 can be formed as an unbalanced circuit, which enables miniaturization of a communication terminal.

A dielectric layer may be provided between the antenna conductor 11 or 21 and the substrate 12 or 22. In this case, the interval between the antenna conductor 11 or 21 and the substrate 12 or 22 can be maintained by a dielectric layer, in which case the physical length of the slot 13 or 23 can be shortened.

The antenna device 20 according to the second embodiment, in which the number of bent portions of the meandering slot 23 is set large, can be made even smaller than in the antenna device 10 according to the first embodiment. Furthermore, the plural short-circuiting conductors 24 and the feed conductor 32 may be formed by bent portions obtained by bending extension portions of the antenna conductor 21 approximately perpendicularly and be connected to the substrate 22. These measures make it possible to construct the antenna device 20 by a small number of components, which means increase in the efficiency of assembling.

The antenna device 10 or 20 may be such that the substrate 12 or 22 is a printed circuit board, the ground conductor 15 or 25 is formed by a ground pattern, and the plural short-circuiting conductors 14 or 24 are connected to the ground pattern of the ground conductor 15 or 25. These measures make it possible to increase the efficiency of assembling of the antenna device 10 or 20.

The circuit components 26 such as a feed circuit may be mounted on either surface of the substrate 22, that is, the outer surface opposite to the antenna conductor 21 or the surface facing the space located on the side of the antenna conductor 21. Where the circuit components 26 are mounted between the antenna conductor 21 and the substrate 22, the thickness of the antenna device 20 can be reduced to contribute to its further miniaturization.

The antenna devices 10 and 20 according to the embodiments can provide such high directivity that a sufficient gain is obtained in the Z-axis direction which is perpendicular to the antenna conductor 11 or 21, and provides an advantage that degradations of its performance due to close existence of a human body are small. As a result, the antenna device 10 or 20 can exhibit high antenna performance even in the case where the antenna device 10 or 20 is installed in an environment of severe use conditions in which the antenna performance would otherwise degrade to a large extent as in a case that it is installed in a small sensor terminal worn by a human, a wearable sensor terminal attached to a human body, or a sensor terminal disposed in such a narrow space as to have a nearby dielectric or conductor such as a metal. This makes it possible to realize an antenna device that is suitable for use in, for example, a sensor terminal that is attached to a human body, detects living body information such as a pulse, and transmits it.

As described above, the embodiments make it possible to construct a slot antenna with a cavity that is small and exhibits good characteristics. As such, the embodiments make it possible to realize a cavity slot antenna that is suitable for use in small communication terminals such as RFID tags and to provide an antenna device that is miniaturized and enhanced in performance.

Each of the antenna devices 10 and 20 according to the embodiments is not limited to the case that the antenna conductor 11 or 21 is formed with only one slot 13 or 23. The antenna conductor 11 or 21 may be formed with plural slots, in which case the outer circumferential length of each slot is set at about $1\lambda$ to $2\lambda$. Where plural slots are formed, the usable frequency range can be expanded. Where two slots are formed, the usable frequency range of the antenna can be expanded to, for example, about 1.5 times a range of the case of one slot. Where plural slots are formed in a single antenna conductor component, the variations of performance due to assembling errors can be reduced.

Each of the above-described antenna devices 10 and 20 according to the embodiments can be applied to small sensor terminals when, for example, RFID is used as a communication system. In this case, a wireless sensor terminal that does not require replacement of a battery can be realized by installing the antenna device 10 or 20 according to the first or second embodiment as an antenna for communication with and reception of power from a reader/writer and thereby constructing an energy harvest terminal. Capable of being constructed to as to be low in height and small, the antenna devices 10 and 20 according to the embodiments can be installed at various places such as narrow locations and places in the vicinity of a human body and thereby contribute to increase of the degree of freedom of the manner of installation of a sensor terminal.

Although the various embodiments have been described above with reference to the drawings, it goes without saying that the invention is not limited to those examples. It is apparent that those skilled in the art would conceive various changes or modifications within the confines of the claims. And such changes or modifications should naturally be construed as being included in the technical scope of the invention. Furthermore, constituent elements of the embodiments can be combined together in a desired manner without departing from the spirit and scope of the invention.

This disclosure is useful in being able to realize a cavity slot antenna that can be applied to small communication terminals such as RFID tags and to provide an antenna device that is miniaturized and enhanced in performance.

What is claimed is:

1. An antenna device comprising:

a substrate having a ground conductor;

a flat-plate-shaped antenna conductor disposed approximately parallel with the ground conductor with an air layer or a dielectric layer interposed between the antenna conductor and the ground conductor, and the antenna conductor having a closed polygon-shaped slot which is bent at at least one position thereof;

plural short-circuiting conductors that connect the antenna conductor to the ground conductor; and a feed conductor disposed in a vicinity of one of the plural short-circuiting conductors and that feeds the antenna conductor with power, wherein when a wavelength of frequency used in the antenna device is represented by $\lambda$, an outer circumferential length of the slot is approximately $1\lambda$ to $2\lambda$ and a width of the slot is $0.005\lambda$ to $0.05\lambda$;

an interval between the plural short-circuiting conductors is shorter than or equal to $\lambda/2$; and a distance between the antenna conductor and the ground conductor is $0.005\lambda$ to $0.05\lambda$.

2. The antenna device according to claim 1, wherein the antenna conductor is configured by a plate-like member having an approximately rectangular external shape and has extension portions which extend from a shorter side or a longer side of the plate-like member and are bent approximately perpendicularly to a plane having the slot to form bent portions; and wherein the short-circuiting conductors are formed by the bent portions of the antenna conductor.

3. The antenna device according to claim 1, wherein the slot has a meandering shape which is bent at plural positions.

4. The antenna device according to claim 1, wherein the substrate is a printed circuit board and the ground conductor is configured by a ground pattern; and wherein the plural short-circuiting conductors are connected to the ground pattern of the ground conductor.

5. The antenna device according to claim 1, further comprising:

a circuit component mounted on the substrate, wherein the circuit component and the antenna conductor are arranged on the substrate.

6. The antenna device according to claim 1, wherein the antenna conductor is configured by a plate-like member having an approximately rectangular external shape, lengths of shorter sides and longer sides of the antenna conductor are $\lambda/8$ to $\lambda/2$, a length of the slot in the longer-side direction of the antenna conductor is shorter than or equal to $\lambda/2$.

7. The antenna device according to claim 1, wherein the antenna conductor has plural slots an outer circumferential length of each of which is approximately $1\lambda$ to $2\lambda$.

* * * * *